US012435381B2

(12) United States Patent
Gerstner et al.

(10) Patent No.: US 12,435,381 B2
(45) Date of Patent: Oct. 7, 2025

(54) STEEL MATERIAL AND METHOD FOR ITS MANUFACTURE

(71) Applicant: Voestalpine Stahl GmbH, Linz (AT)

(72) Inventors: Florian Gerstner, Aalen (DE); Andreas Sommer, Abtsgmünd (DE); Siegfried Kolnberger, Pasching (AT); Thomas Kurz, Linz (AT)

(73) Assignee: voestalpine Stahl GmbH, Linz (AT)

( * ) Notice: Subject to any disclaimer, the term of this patent is extended or adjusted under 35 U.S.C. 154(b) by 0 days.

(21) Appl. No.: 18/037,150

(22) PCT Filed: Nov. 18, 2021

(86) PCT No.: PCT/EP2021/082190
§ 371 (c)(1),
(2) Date: May 16, 2023

(87) PCT Pub. No.: WO2022/106561
PCT Pub. Date: May 27, 2022

(65) Prior Publication Data

US 2024/0002965 A1 Jan. 4, 2024

(30) Foreign Application Priority Data

Nov. 19, 2020 (DE) ..... 10 2020 130 543.5

(51) Int. Cl.
*C21D 1/18* (2006.01)
*C21D 8/02* (2006.01)
(Continued)

(52) U.S. Cl.
CPC ..... *C21D 1/18* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS

2010/0026048 A1 2/2010 Vlot et al.

FOREIGN PATENT DOCUMENTS

DE 102011053939 A1 3/2013
DE 102018114838 A1 12/2019
(Continued)

OTHER PUBLICATIONS

Espacenet Bibliographic data and Machine Translation for DE102018114838 A1, published Dec. 24, 2019 12 pages.
(Continued)

*Primary Examiner* — Daniel J. Schleis
(74) *Attorney, Agent, or Firm* — Maxwell J. Petersen; FisherBroyles, LLP

(57) ABSTRACT

The method relates to a press-hardened component with a tensile strength $R_m$>1600 MPa, in particular >1800 MPa, and especially >2000 MPa, wherein the component is manufactured from a steel material, wherein the steel material is a boron-manganese steel, which has a carbon content >0.30 mass %, wherein the steel material is hot rolled or hot rolled and cold rolled to a strip with a thickness of 0.5 to 3 mm, wherein the strip has a thin coating of zinc or a zinc-based alloy and a coating weight of <50 g/m$^2$ on each strip side of the steel strip.

21 Claims, 1 Drawing Sheet

| No. | Example according to the invention | Description | Strength | Corrosion protection | Tool wear | Coefficient of friction | LME avoidance | Furnace process window | H embrittlement susceptibility | Adhesive suitability |
|---|---|---|---|---|---|---|---|---|---|---|
| 1 | prior art | PHS 1500 Z140 (ind) | 0 | ++ | ++ | na | + | + | ++ | + |
| 2 | prior art | PHS 1500 ZF180 (dir+pc) | 0 | ++ | + | ++ | + | + | ++ | + |
| 3 | prior art | PHS 1500 AlSi (dir) | 0 | + | 0 | 0 | ++ | + | 0 | - |
| 4 | prior art | PHS 1500 uncoated (dir) | 0 | - | - | - | ++ | ++ | ++ | ++ |
| 5 | prior art | PHS 2000 Z140 (ind) | ++ | ++ | ++ | na | + | + | - | + |
| 6 | prior art | PHS 2000 ZF180 (dir+pc) | ++ | ++ | + | ++ | + | + | - | + |
| 7 | prior art | PHS 2000 AlSi (dir) | ++ | + | 0 | 0 | ++ | + | - | - |
| 8 | prior art | PHS 2000 uncoated (dir) | ++ | - | - | - | ++ | ++ | 0 | ++ |
| 9 | x | PHS 2000 ZF80 (dir) | ++ | 0 | + | ++ | ++ | ++ | 0 | + |
| 10 | x | PHS 2000 ZF80 (ind) | ++ | 0 | ++ | na | ++ | ++ | 0 | + |

pc = pre-cooling na = not applicable

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C23C 2/06*** | (2006.01) |
| ***C23C 2/40*** | (2006.01) |
| ***C25D 3/22*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C23C 2/06* (2013.01); *C23C 2/40* (2013.01); *C25D 3/22* (2013.01)

(56) References Cited

FOREIGN PATENT DOCUMENTS

| | | | |
|---|---|---|---|
| JP | 2014015638 | A | 1/2014 |
| WO | WO2020108594 | A1 * | 6/2020 |

OTHER PUBLICATIONS

Espacenet Bibliographic data and Machine Translation for JP2014015638 A, published Jan. 30, 2014 18 pages.
Espacenet Bibliographic data and Machine Translation for DE102011053939 A1, published Mar. 28, 2013 18 pages.

* cited by examiner

| No. | Example according to the invention | Description | Strength | Corrosion protection | Tool wear | Coefficient of friction | LME avoidance | Furnace process window | H embrittlement susceptibility | Adhesive suitability |
|---|---|---|---|---|---|---|---|---|---|---|
| 1 | prior art | PHS 1500 Z140 (ind) | 0 | ++ | ++ | na | + | + | ++ | + |
| 2 | prior art | PHS 1500 ZF180 (dir+pc) | 0 | ++ | + | ++ | + | + | ++ | + |
| 3 | prior art | PHS 1500 AlSi (dir) | 0 | + | 0 | 0 | ++ | + | 0 | - |
| 4 | prior art | PHS 1500 uncoated (dir) | 0 | - | - | - | ++ | ++ | ++ | ++ |
| 5 | prior art | PHS 2000 Z140 (ind) | ++ | ++ | ++ | na | + | + | - | + |
| 6 | prior art | PHS 2000 ZF180 (dir+pc) | ++ | ++ | + | ++ | + | + | - | + |
| 7 | prior art | PHS 2000 AlSi (dir) | ++ | + | 0 | 0 | ++ | + | - | - |
| 8 | prior art | PHS 2000 uncoated (dir) | ++ | - | - | - | ++ | ++ | 0 | ++ |
| 9 | x | PHS 2000 ZF80 (dir) | ++ | 0 | + | ++ | ++ | ++ | 0 | + |
| 10 | x | PHS 2000 ZF80 (ind) | ++ | 0 | ++ | na | ++ | ++ | 0 | + |

pc = pre-cooling na = not applicable

STEEL MATERIAL AND METHOD FOR ITS MANUFACTURE

CROSS-REFERENCE TO RELATED APPLICATIONS

This application claims priority to International Patent Application Number PCT/EP2021/082190 filed 18 Nov. 2021, and to German Patent Application Number 10 2020 130 543.5, filed 19 Nov. 2020, both of which are hereby incorporated by reference in their entireties.

The invention relates to a steel material and a method for its manufacture.

It is known, particularly in automobile bodies, for structural components and in particular structural components that form the passenger compartment or load-bearing components to be made of high-strength steel grades. The use of high-strength steel grades and high-strength components made of steel has the advantage that with a very high strength, these components can be produced with a comparatively low wall thickness, which therefore in turn reduces the vehicle weight and thus fuel consumption.

In vehicle body construction, known efforts to achieve this through the hardening of components have been underway since the middle of the 1980s.

In order to produce such high-strength steel components, two methods have gained acceptance in the prior art, namely press hardening and form hardening, which was developed by the applicant.

Both methods share the fact that quenching at a speed above the critical hardening speed is used to influence the resulting steel structure so that the steel becomes very hard.

In press hardening, a sheet bar made of an appropriately hardenable steel is heated to a temperature that is high enough that the steel structure partially or completely transforms into austenite. This transformation usually takes place above the austenite transformation temperature $A_c$3. This $A_c$3 temperature depends on the steel material and its alloying state and is usually between 720 and 920° C.

A steel sheet bar that is heated in this way is then transferred to a forming tool; it retains its austenitic state and in this forming tool, is brought into the shape of the desired component with one forming stroke or several forming strokes. The forming tool in this case is cold enough that its contact with the austenitic sheet bar during the forming and then with the component that the forming produces dissipates the heat from the steel into the forming tool quickly enough that the critical hardening speed is exceeded. As a result of this, the structure of the steel is transformed from an austenitic structure into a predominantly or completely martensitic structure.

This martensite transformation requires the steel to contain certain amounts of carbon; very simply put, the higher the carbon content, the greater the hardening effect. The hardening effect is based on the fact that, also very simply put, the austenite lattice can dissolve carbon better than the resulting martensite lattice so that lattice strains or carbide precipitations occur in the martensite lattice, which result in a distortion of the lattice that causes the high hardness.

Another way to produce hardened components of this kind is the form hardening that has already been mentioned above. The physical requirements and metallurgical requirements of the steel in this case are basically the same as in press hardening. But in form hardening, the component is first cold formed, specifically using a conventional forming method. The conventional forming method for steel is deep drawing; this is often done using five-stage pressing lines in which such a component is formed into the final component by means of five pressing strokes. The plurality of pressing strokes makes it basically possible to achieve more complex components than would be possible with press hardening since the latter provides only one pressing stroke for the forming and hardening because after the first forming stroke, the component has already been hardened to such a degree that for all practical purposes, it can't be formed any further.

In form hardening, the finally formed component is then heated intensely enough that the steel reaches its austenitic state and in the austenitic state, is transferred to a form hardening tool. The form hardening tool has dimensions that are 0.2% larger than the desired geometry of the finished component. It is particularly advantageous if in the form hardening process, after the cold forming, the component has dimensions in all three spatial directions such that because of the thermal expansion, after the heating and above all upon insertion into the form hardening tool, it is exactly the size of the desired component in all three spatial directions and in particular, is exactly the size that is also predetermined by the form hardening tool. Consequently, the heated component then fits perfectly into the form hardening mold, is inserted into it, and the form hardening mold closes and clamps the hot component from all sides. The form hardening tool is also cold so that the heat is dissipated from the steel into the tool, likewise at a speed that is above the critical hardening speed.

Thus in form hardening as well, the austenitic structure is then transformed into a martensitic structure with the hardening effect that has already been described above.

The press hardening method is also referred to as the direct method because the hardening and forming take place directly, i.e. at the same time. The form hardening process is also referred to as the indirect method because the hardening does not involve carrying out any further forming or in any case, only slight forming or calibration procedures.

In order to ensure that the critical hardening speed is exceeded—this speed is usually between 20 and 25 Kelvin per second and the tools usually exceed it significantly—the tools can be cooled in the usual way and for example can have a liquid cooling.

The above-mentioned methods can produce components that achieve tensile strengths $R_m$ of greater than 1600 MPa, in particular greater than 1800 MPa, and even up to greater than 2000 MPa.

In this case, depending on the manufacturer, the materials are known by different names, but in general are often referred to in the prior art as for example PHS1500 for grades that can attain a tensile strength of 1500 MPa in press hardening or form hardening or PHS2000 for grades that can attain a tensile strength of 2000 MPa and above.

It has also long been known to provide such components with a metallic corrosion protection coating. Basically, the metallic corrosion protection coating was needed in order to meet two essential requirements. One requirement is that the metallic corrosion protection coating must prevent surface oxidation and scale formation on the material during the heating. The second, more important effect is that press-hardened or form-hardened components with a corresponding metallic coating fit better into the overall corrosion protection concept of the vehicle, in particular car. Whereas at first, only aluminum-based metallic corrosion protection coatings were used because it was assumed that only these would be able to withstand the high-temperature process for the heating to the hardening temperature, later it was also possible, through a special chemical selection, to use zinc-based metallic corrosion protection coatings, which can be integrated into a fully galvanized body better than aluminum-coated sheets, which can (but do not necessarily) lead to contact corrosion.

In the materials that are used, metallic corrosion protection coatings are often identified by abbreviations; the abbreviation AS usually stands for aluminum-silicon layers, the abbreviation Z stands for zinc layers or zinc-based layers produced by means of hot-dipping, and the abbreviation ZF stands for zinc layers, which, after the hot-dip coating process, by means of a subsequent heat treatment step, have undergone a diffusion-induced alloying with the underlying steel sheet, i.e. so-called galvannealing layers. These feature the fact that usually up to 15%, preferably between 8% and 14%, of iron has diffused into the zinc layer. ZE stands for zinc-based layers that have been applied by means of an electrolytic method.

It is also customary for this abbreviation to be followed by a number, which indicates the coating weight in grams per $m^2$. A Z140 coating therefore means that it is a zinc coating applied by means of hot-dipping with a coating layer totaling 140 g per $m^2$ on both sides of the strip. In other words, in Z140, each side of the strip has 70 g Zn per $m^2$ applied to it.

In the prior art, steel materials in the form of so-called boron-manganese steels are used, i.e. steels alloyed with boron and manganese. One example of these steels that is the most widely used for this purpose is 22MnB5; the number 22 in this case indicates the carbon content, i.e. 0.22% carbon.

But other grades are also known, particularly in order to achieve very high strengths; in particular, 34MnB5 should be mentioned here; in this case, the carbon content—for the reasons already mentioned above—is higher, namely 0.34%. In addition to 34MnB5, higher boron-alloyed variants such as 34MnB7 or 34MnB8 can also be used.

In the prior art, it has turned out that the materials with a higher carbon content are particularly well-suited to develop tensile strengths of greater than 2000 MPa after the press hardening or form hardening.

Particularly high-strength grades, i.e. grades that can achieve tensile strengths of greater than 2000 MPa, are currently processed either in uncoated form or provided with an aluminum-silicon coating. These high-strength steel grades can frequently, but do not always, have certain problems with regard to hydrogen absorption during the heating for the austenitization. For this reason, when such materials, in particular high-carbon materials, are being used, the furnace atmosphere is specially adjusted and in particular, processing is carried out at a very low dew point.

The object of the invention is to create a steel material, which can in particular be produced in a simpler and improved way as an extremely high-strength steel material with tensile strengths of greater than 2000 MPa.

The object is attained with a steel material having the features of claim 1.

Advantageous modifications are disclosed in the dependent claims.

The steel material according to the invention is a steel material that can be hardened by means of quench hardening, which consists of a boron-manganese steel with a high carbon content.

In particular, the steel material is a material, which contains more than 0.30% carbon, and in particular, is a steel of the 34MnB5 type.

A steel material composition according to the invention is as follows, with all of the values indicated in mass percent:

carbon (C) 0.30-0.60
manganese (Mn) 0.5-3.0
aluminum (Al) 0.01-0.30
silicon (Si) 0.01-0.5
chromium (Cr) 0.01-1.0
titanium (Ti) 0.01-0.08
niobium (Nb) 0.001-0.06
nitrogen (N) <0.02
boron (B) 0.002-0.02
phosphorus (P) <0.015
sulfur (S) <0.01
molybdenum (Mo) <1
residual iron and inevitable smelting-related impurities.

A particularly preferred composition of the steel material can be composed as follows, with all of the values indicated in mass percent:

carbon (C) 0.32-0.38
manganese (Mn) 0.8-1.5
aluminum (Al) 0.025-0.20
silicon (Si) 0.01-0.5
chromium (Cr) 0.01-0.25
titanium (Ti) 0.025-0.08
niobium (Nb) 0.001-0.06
nitrogen (N) <0.006
boron (B) 0.002-0.008
phosphorus (P) <0.012
sulfur (S) <0.002
molybdenum (Mo) <1
residual iron and inevitable smelting-related impurities.

The steel material can particularly excel if the following condition is fulfilled:

$$(Al-0.02)/(15.4*N)+Ti/(3.25*N)+Nb/(13.3*N)>=1$$

In this case, the ratio of aluminum, titanium, and niobium with reference to nitrogen is advantageously adjusted in order to activate the boron as effectively as possible as a hardening element in the steel material and to be able to achieve correspondingly high tensile strength values.

According to the invention, contrary to the usual practice with galvanized hardenable steels and contrary to the prevailing wisdom among experts, the material is provided with a thin zinc alloy coating. According to the invention, though, the zinc alloy coating is extremely thin and is <7 μm on each strip side, preferably <6 μm on each strip side. For example, this therefore corresponds to a ZF80 coating layer (approx. 35 g/$m^2$ Zn on each strip side).

Contrary to the prevailing wisdom among experts, a thick zinc layer was not applied since a cathodic corrosion protection is not the main focus.

According to the invention, it has been discovered that even a zinc alloy layer that is this thin homogenizes the heating behavior of the steel in the furnace across the surface of the strip. In uncoated steel sheets, because of an uneven distribution of oil, the heating behavior can vary significantly from one area to the next. In addition, the oxide adhesion can vary significantly from one area to the next due to manufacture-related irregularities and as a result, the effect of cleaning and conditioning processes, in particular airless blast cleaning, can vary from one area to the next. In addition, compared to uncoated extremely high-strength steel sheets, it is advantageous that the processing is more reasonably priced since despite the thin zinc layer, production can be carried out without protective gas, in particular it is advantageously possible to use existing systems. Surprisingly, there was a significantly improved formability and a much lower tool wear. Also compared to sheets coated with aluminum-silicon layers, the processing is more reasonably priced and surprisingly, compared to aluminum-silicon-coated sheets, the heating occurs more rapidly so that the minimum furnace dwell time is significantly reduced. This is attributed to the fact that the emissivity is significantly better right from the start and complete reaction of the layers is not required and can be carried out much more rapidly.

For this reason, a coating weight of less than 50 g/m$^2$, in particular less than 45 g/m$^2$, particularly preferably less than 40 g/m$^2$, can advantageously offer a reduced friction and thus reduced wear. On the other hand and additionally, the coating weight can be greater than 20 g/m$^2$, in particular greater than 25 g/m$^2$, particularly preferably greater than 30 g/m$^2$, in order to homogenize the heating behavior even further and to even more positively influence the oxide layer formation.

Compared to aluminum-silicon-coated steels, it is also advantageous that clearly no hydrogen problem occurs because no dew point control or dry air injection are required in the furnace. In tests, it was possible to establish that the hydrogen loading after the furnace process, i.e. after the austenitization, is significantly lower. Another very surprising effect that was observed is that although such materials were previously quite unsuitable for adhesive bonds, the material according to the invention can easily be used for such bonds. The material provided with the particularly thin zinc layer is outstandingly suitable for adhesive bonds. Even at very low testing temperatures, this bond does not exhibit any local delamination phenomena. In addition, the sheets are much more suitable for welding compared to sheets that are uncoated and sheets that are not after-treated and compared to aluminum-silicon-coated sheets. Compared to thick zinc coatings, it was possible to establish that the heating rate is higher here, too; the zinc coating is so thin that no embrittlement due to contact of austenite with liquid zinc phases, so-called liquid metal embrittlement (LME), occurs.

It was surprisingly possible to establish that in a direct forming, i.e. a press hardening, despite the thin zinc coating, the coefficients of friction in the tool—despite the thin layer—were just as good as with a significantly thicker zinc layer, for example Z140 or Z200. In the indirect method, i.e. in form hardening, it was also possible to observe—unlike with AlSi—a very good formability without delamination; in addition, here, too, the hydrogen loading was significantly lower than with an uncoated material or an AlSi material.

The invention therefore relates to a steel material for manufacturing high-strength or extremely high-strength components with a tensile strength $R_m$>1600 MPa, in particular >1800 MPa, and especially >2000 MPa, wherein the steel material is a boron-manganese steel, which has a carbon content >0.30 mass %, wherein the steel material is hot rolled or hot rolled and cold rolled to a strip with a thickness of 0.5 to 3 mm, wherein the strip has a thin coating of zinc or a zinc-based alloy with a coating weight of <50 g/m$^2$ on each strip side of the steel strip.

The invention also relates to a steel material wherein the steel material has the following alloy composition (all values indicated in mass %):

carbon (C) 0.30-0.60
manganese (Mn) 0.5-3.0
aluminum (Al) 0.01-0.30
silicon (Si) 0.01-0.5
chromium (Cr) 0.01-1.0
titanium (Ti) 0.01-0.08
niobium (Nb) 0.001-0.06
nitrogen (N) <0.02
boron (B) 0.002-0.02
phosphorus (P) <0.015
sulfur (S) <0.010
molybdenum (Mo) <1
residual iron and smelting-related impurities.

In an advantageous modification, the steel material has the following alloy composition (all values indicated in mass %):

carbon (C) 0.32-0.38
manganese (Mn) 0.8-1.5
aluminum (Al) 0.025-0.20
silicon (Si) 0.01-0.5
chromium (Cr) 0.01-0.25
titanium (Ti) 0.025-0.08
niobium (Nb) 0.001-0.06
nitrogen (N) <0.006
boron (B) 0.002-0.008
phosphorus (P) <0.012
sulfur (S) <0.002
molybdenum (Mo) <1
residual iron and smelting-related impurities.

In an advantageous modification, the steel material fulfills the following condition (in mass %)

$$(Al-0.02)/(15.4*N)+Ti/(3.25*N)+Nb/(13.3*N)>=1$$

In another advantageous modification, the coating weight is <45 g/m$^2$, in particular <40 g/m$^2$, particularly preferably <30 g/m$^2$ on each strip side of the steel strip In an advantageous modification, the coating consists of zinc or a zinc-based alloy or is a coating that is transformed on the steel strip into a zinc-iron layer by means of a temperature treatment.

The invention also relates to a method for manufacturing a steel material, wherein a melt for a boron-manganese steel with a carbon content >0.3 mass % is melted and then cast, wherein the resulting slab ingot is hot rolled or hot rolled and cold rolled, in order to obtain a steel strip with a thickness of 0.5 to 3 mm, wherein by means of a galvanization method, the resulting steel strip is coated with a coating of zinc or a zinc-based alloy, wherein the coating has a coating weight of <50 g/m$^2$ on each strip side.

In a modification, a heat treatment following the galvanization is used to transform the zinc layer into a zinc-iron layer with a proportion of 8 to 18 mass % iron, preferably 10 to 15 mass % iron.

In an advantageous embodiment, the zinc layer is deposited by means of a hot-dip coating (hot-dip galvanization), an electrolytic galvanization, or a PVD method.

In an advantageous modification, in addition to zinc, the coating can contain other elements such as aluminum, magnesium, nickel, chromium, tin, iron, or a mixture thereof, which are deposited together. The sum of these elements can be less than 25 mass %, preferably less than 15 mass %, particularly preferably less than 5 mass %. This means that the coating contains at least 75 mass % zinc.

The invention also relates to a method for manufacturing components, in particular hardened components made of a steel material, wherein one of the above-mentioned steel materials according to the invention is press hardened or form hardened.

In a modification, for austenitization purposes, the steel material is heated to a temperature between 700 and 950° C., is optionally kept at the temperature until it has reached a desired degree of austenitization, and is then hardened, wherein the material is either completely formed before the heating or is formed after the heating.

BRIEF DESCRIPTION OF DRAWING

FIG. 1 is a Table showing several physical properties of steel materials of the prior art and of the invention.

The invention will be explained below based on the drawings whose sole figure shows a comparison of the different properties of various comparison materials.

In this figure, the numbers 1 to 4 each represent a respective material with a tensile strength of about 1500 MPa and different coating types. In this case, AlSi stands for known coatings made of aluminum-silicon, also known as Usibor. "Uncoated" refers to bare material. The press hardening method used is then also indicated in parentheses; "ind" stands for the indirect process and "dir" stands for the direct hot forming process. The abbreviation "pc" stands for a known pre-cooling method in which before the forming, the steel sheet bar is cooled to a temperature of 400° C. to 650° C.

The numbers 5 to 8 show a corresponding material with a tensile strength of about 2000 MPa, once again with different coating types.

All of the examples 1 to 8 are not according to the invention, but instead known materials from the prior art.

In the columns next to the description, the individual mechanical values are listed and assessed according to their suitability. Here, "–" indicates a poor suitability, "0" indicates an average suitability, "+" indicates a good suitability, and "++" indicates an outstanding suitability. The entry "na" stands for values that are not applicable, for example a friction value is not applicable to the indirect process.

The steel material according to the invention is a steel material composed of a high or higher carbon-containing boron-manganese steel, in particular a steel with more than 0.30 mass % carbon and in particular a 34MnB5. The examples according to the invention are labeled with number 9 and number 10 in FIG. 1.

This material has been melted in accordance with the customary analysis of a 34MnB8 and has been cast using continuous casting and has then been hot rolled and if so desired, optionally cold rolled.

The steel material, as a strip or sheet, has a thickness of 0.5 to 3 mm, as do the sheet bars that are cut from it.

For the further processing, the hot-rolled or optionally hot-rolled and cold-rolled steel material is provided with a zinc coating or a coating with a zinc-based alloy or a zinc-iron layer.

Options for the galvanization include an electrolytic galvanization, a galvanization by means of PVD methods, or a hot-dip galvanization.

In all three cases, the zinc coating is set to ≤7 μm, particularly preferably s 6 μm, on both sides of the strip.

If so desired, the zinc layer (Z/FVZ) on the steel strip can be transformed into a zinc-iron layer (ZF) by being heated to temperatures between 400 and 600° C.

For the further processing into components, segments—so-called sheet bars—are cut out from this sheet steel strip. For the processing using the press hardening method, i.e. in the direct method, the sheet bars are transferred to a furnace and are conveyed through the furnace and in the furnace, are heated above the austenitization temperature ($A_c$3) and optionally kept at this temperature until a desired degree of austenitization, in particular a complete austenitization, has been achieved.

Then the sheet bars that have been austenitized in this way are removed and transferred to a forming tool in which the sheet bars are formed with a single stroke and simultaneously quenched and thus hardened by the cold tool.

For the indirect method, the sheet bars undergo a one-step or multi-step forming and in this process, are formed into the desired component, wherein with each forming stroke, the degree of forming usually increases and the products are transferred between the individual forming stations. The trimming preferably occurs as part of the forming.

After the last forming station, i.e. when the forming has been completed to the desired degree, i.e. a finished component has been produced, then the components are conveyed to a furnace and are austenitized in the furnace and after the desired degree of austenitization has been achieved, are removed and transferred to a form hardening tool in which the component is clamped by the closing of the forming tool and as a result, quenched and hardened.

Suitable options for the furnace are conventional continuous furnaces, whose corresponding cycle rates are usually adapted to the process.

Components manufactured in this way are compared to other components in FIG. 1. In this case, the two materials at the bottom are materials according to the invention, which have a very high strength class, namely a tensile strength $R_m$ of greater than 2000 MPa. It is clear that the corrosion protection is indeed lower compared to thicker zinc layers, but corrosion protection is not the primary objective of the thin zinc layer. Primarily, in comparison to high-strength steel grades that are coated with aluminum-silicon (AlSi) or are uncoated, the material has a significantly less problematic behavior in the furnace since a protective gas atmosphere and dew point control are not needed and the furnace processing window is larger. With the material according to the invention, the risk of hydrogen being absorbed in the PHS furnace is significantly lower than with an AlSi-coated material and the risk of hydrogen being absorbed in the course of the welding, cutting, phosphating, cathodic dip painting, or possible corrosion is significantly lower than with thicker zinc layers. It is surprising that the material has a significantly better adhesively bonding capacity than all of the other materials and to this extent, is specifically predestined for applications in which a glued structure is used, and in this case, also offers the possibility of introducing very high-strength steel grades.

The invention therefore has the advantage that a steel material is produced, which has an improved heating behavior in the furnace and which enables a lower furnace dwell time and thus higher cycle rates.

In addition, in comparison to a normally galvanized material or aluminum-silicon-coated material with a comparable tensile strength, the material is less susceptible to hydrogen-inclusion phenomena, both during the austenitization and in other processing steps.

In addition, the thin zinc layer is surprisingly able to ensure the same low coefficients of friction as significantly thicker coatings, even during forming.

The invention claimed is:

1. A press hardened component with a tensile strength $R_m$>1600 MPa, wherein the component is manufactured from a steel material, wherein the steel material is a boron-manganese steel, which has a carbon content >0.30 mass %, wherein the steel material is (a) hot rolled or (b) hot rolled and cold rolled to a strip with a thickness of 0.5 to 3 mm, wherein the strip has a coating of zinc or a zinc alloy directly applied to the steel material at a coating weight of <50 g/m$^2$ on each side of the strip.

2. The press hardened component of claim 1, wherein the steel material has the following alloy composition (in mass %):

carbon (C) 0.30-0.60
manganese (Mn) 0.5-3.0
aluminum (Al) 0.01-0.30
silicon (Si) 0.01-0.5
chromium (Cr) 0.01-1.0 titanium (Ti) 0.01-0.08
niobium (Nb) 0.001-0.06
nitrogen (N)<0.02
boron (B) 0.002-0.02
phosphorus (P)<0.015
sulfur(S)<0.010
molybdenum (Mo)<1
residual iron and smelting-related impurities.

3. The press hardened component of claim 1, wherein the steel material has the following alloy composition (in mass %):
carbon (C) 0.32-0.38
manganese (Mn) 0.8-1.5
aluminum (Al) 0.025-0.20
silicon (Si) 0.01-0.5
chromium (Cr) 0.01-0.25
titanium (Ti) 0.025-0.08
niobium (Nb) 0.001-0.06
nitrogen (N)<0.006
boron (B) 0.002-0.008
phosphorus (P)<0.012
sulfur(S)<0.002
molybdenum (Mo)<1
residual iron and smelting-related impurities.

4. The press hardened component of claim 1, wherein the steel material fulfills the following condition (in mass %)

$$(Al-0.02)/(15.4*N)+Ti/(3.25*N)+Nb/(13.3*N)>=1.$$

5. The press hardened component of claim 1, wherein the coating weight is >20 g/m$^2$, on each side of the steel strip.

6. The press-hardened component of claim 1, wherein the tensile strength Rm is greater than 1800 MPa.

7. The press-hardened component of claim 1, wherein the tensile strength Rm is greater than 2000 MPa.

8. The press-hardened component of claim 1, wherein the coating comprises a zinc-alloy having an iron content of 8 to 18 mass percent iron.

9. The press-hardened component of claim 1, wherein the coating weight is less than 40 g/m$^2$ on each side of the strip.

10. A press hardened component with a tensile strength $R_m$>1600 MPa, comprising a steel material having an alloy composition that includes, in mass %:
carbon (C) 0.30-0.60
manganese (Mn) 0.5-3.0
aluminum (Al) 0.01-0.30
silicon (Si) 0.01-0.5
chromium (Cr) 0.01-1.0
titanium (Ti) 0.01-0.08
niobium (Nb) 0.001-0.06
nitrogen (N)<0.02
boron (B) 0.002-0.02
phosphorus (P)<0.015
sulfur(S)<0.010
molybdenum (Mo) <1
residual iron and smelting-related impurities;
wherein the steel material is (a) hot rolled or (b) hot rolled and cold rolled, to a strip with a thickness of 0.5 to 3 mm, wherein the strip has a coating of zinc or a zinc alloy directly applied to the steel material and having a coating weight of <50 g/m$^2$ and a thickness of less than 7 microns on each side of the steel strip.

11. The press hardened component of claim 10, wherein the steel material fulfills the following condition (in mass %)

$$(Al-0.02)/(15.4*N)+Ti/(3.25*N)+Nb/(13.3*N)>=1.$$

12. The press-hardened component of claim 10, wherein the tensile strength Rm is greater than 1800 MPa.

13. The press-hardened component of claim 10, wherein the tensile strength Rm is greater than 2000 MPa.

14. The press-hardened component of claim 10, wherein the coating comprises a zinc-alloy having an iron content of 8 to 18 mass percent iron.

15. The press-hardened component of claim 10, wherein the coating weight is less than 40 g/m$^2$ on each side of the strip.

16. A press hardened component with a tensile strength $R_m$>1600 MPa, comprising a steel material having an alloy composition that includes, in mass %:
carbon (C) 0.32-0.38
manganese (Mn) 0.8-1.5
aluminum (Al) 0.025-0.20
silicon (Si) 0.01-0.5
chromium (Cr) 0.01-0.25
titanium (Ti) 0.025-0.08
niobium (Nb) 0.001-0.06
nitrogen (N)<0.006
boron (B) 0.002-0.008
phosphorus (P)<0.012
sulfur(S)<0.002
molybdenum (Mo) <1
residual iron and smelting-related impurities;
wherein the steel material is (a) hot rolled or (b) hot rolled and cold rolled, to a strip with a thickness of 0.5 to 3 mm, wherein the strip has a coating of zinc or a zinc alloy including at least 75 mass % zinc directly applied to the steel material at a coating weight of <50 g/m$^2$ on each side of the steel strip.

17. The press hardened component of claim 16, wherein the steel material fulfills the following condition (in mass %)

$$(Al-0.02)/(15.4*N)+Ti/(3.25*N)+Nb/(13.3*N)>=1.$$

18. The press-hardened component of claim 16, wherein the tensile strength Rm is greater than 1800 MPa.

19. The press-hardened component of claim 16, wherein the tensile strength Rm is greater than 2000 MPa.

20. The press-hardened component of claim 16, wherein the coating comprises a zinc-alloy having an iron content of 8 to 18 mass percent iron.

21. The press-hardened component of claim 16, wherein the coating weight is less than 40 g/m$^2$ on each side of the strip.

* * * * *